US006923644B2

(12) United States Patent
Lavigne et al.

(10) Patent No.: US 6,923,644 B2
(45) Date of Patent: Aug. 2, 2005

(54) RADIANT PANEL

(75) Inventors: Daniel Lavigne, Avenue des Bouvreuils, 18, B-1301 Bierges (BE); Koen Van Overbeke, Keerbergen (BE)

(73) Assignee: Daniel Lavigne (BE)

( * ) Notice: Subject to any disclaimer, the term of this patent is extended or adjusted under 35 U.S.C. 154(b) by 0 days.

(21) Appl. No.: 10/631,852

(22) Filed: Aug. 1, 2003

(65) Prior Publication Data

US 2004/0191716 A1 Sep. 30, 2004

(30) Foreign Application Priority Data

Aug. 2, 2002 (BE) ..... 2002/0466

(51) Int. Cl.[7] ..... F23D 3/40
(52) U.S. Cl. ..... 431/326; 126/25 R
(58) Field of Search ..... 431/326, 328, 431/329; 136/244, 245; 99/427, 349; 126/25 R, 338

(56) References Cited

U.S. PATENT DOCUMENTS 4,829,158 A * 5/1989 Burnham ..... 219/400
5,820,361 A 10/1998 Lavigne et al.
5,996,575 A * 12/1999 Shimek et al. ..... 126/512
6,007,329 A 12/1999 Meyer
6,012,380 A * 1/2000 Hermansson ..... 99/337
6,039,039 A * 3/2000 Pina, Jr. ..... 126/25 R
6,101,768 A * 8/2000 Springstead et al. ..... 52/126.6
6,190,162 B1 * 2/2001 Smith et al. ..... 431/328
6,201,181 B1 * 3/2001 Azzam et al. ..... 136/244

* cited by examiner

*Primary Examiner*—Stephen Gravini
(74) *Attorney, Agent, or Firm*—DLA Piper Rudnick Gray Cary US LLP

(57) ABSTRACT

A radiant panel provided with a frame on which at least one pair of projections, each comprising a first and second projection, are disposed, the first and second projections being in each case disposed at a distance from each other on a longitudinal edge of the frame, each projection being provided with an orifice, said radiant panel also comprising, per pair of projections, a movable bar having a first and second end situated opposite to each other, said bar being arranged so that each of the ends can be engaged in one of the respective orifices, said bar serving to press a grille against the frame. The first end of the bar comprises a first tooth sized so as to be able to pass through said orifice whilst making the bar pivot and abut against the projection when the bar passes through the orifice, the bar also comprising a flexible blade arranged so as to limit the movement of the bar when, in the grille fixing position, it passes through the orifices in the pair of projections to which it has been allocated.

13 Claims, 4 Drawing Sheets

RADIANT PANEL

The invention concerns a radiant panel provided with a frame on which at least one pair of projections, each comprising a first and second projection, are disposed, the first and second projections being in each case disposed at a distance from each other on a longitudinal edge of the frame, each projection being provided with an orifice, said radiant panel also comprising, per pair of projections, a movable bar having a first and second end situated opposite to each other, the said bar being arranged so that each of the ends can be engaged in one of the respective orifices, said bar serving to press a grille against the frame.

Radiant panels are widely used in industry, in particular in the papermaking industry for drying cellulosic lattices.

The patent U.S. Pat. No. 6,007,329 describes a radiant panel comprising a frame provided with two pairs of projections situated on the sides of the frame. The bar, which comprises a hollow at one of its ends, is arranged so as to slide in a first projection provided with a fixed connection means arranged so as to lock the bar in a longitudinal direction. Once the first end of the bar is inserted in the first projection, the operator can slide the second end into the second projection and insert therein, in an opening situated in the second projection, a movable connection means, locking the bar in the longitudinal direction. The bar thus fixed serves to press the grille against the frame.

One disadvantage of known radiant panels is that the positioning or replacement of the grille may prove to be tricky. The operator must in fact not only hold the grille in place but also the bars whilst he inserts the movable connection means.

The aim of the invention is to produce a radiant panel which can be mounted and replaced more easily, whilst guaranteeing suitable holding of the grille.

To this end a radiant panel according to the invention is characterized in that the first end of the bar comprises a first tooth sized so as to be able to pass through said orifice whilst making the bar pivot and abut against the projection when the bar passes through the orifice, the bar also comprising a flexible blade arranged so as to limit the movement of the bar when, in the grille fixing position, it passes through the orifices in the pair of projections to which it has been allocated. The fact that the bar must pivot in the orifice in order to pass through the latter means that the bar is already holding the grille when the bar is mounted in the projection. The presence of the first tooth and the flexible blade makes it possible to hold the grille by means of the bar and projections and to limit the movement of the bar, thus preventing unintentional dislodging of the grille. The mounting and replacement of the grille therefore entails only a pivoting and a translation movement of the bar.

A first embodiment of a radiant panel according to the invention is characterized in that a second tooth juxtaposes the first tooth, said second tooth being sized so as to be situated in the orifice when the bar is in said fixing position. A movement of the bar in the vertical direction is thus limited.

A second embodiment of a radiant panel according to the invention is characterized in that the first tooth and the flexible blade are applied to one and the same end of the bar and extend on each side of the orifice when the bar is in said fixing position. The entire operation of fixing the bar is thus essentially transferred to one and the same projection.

A third embodiment of a radiant panel according to the invention is characterized in that the flexible blade is situated at the second end of the bar. The fixing of the bar in the projections is thus carried out on the two projections in the same pair.

A stop is preferably situated under the flexible blade. The movement of the flexible blade is thus limited when the bar is in the fixing position.

The invention will now be described in more detail with the help of the drawings, which set out example embodiments of a radiant panel according to the invention. In the drawings:

FIG. 1 illustrates schematically the frame of a radiant panel provided with a grille;

FIGS. 2 and respectively 3 illustrate a first and respectively a second embodiment of a bar forming part of a radiant panel according to the invention;

FIGS. 4 and respectively 5 illustrate part of the frame of a radiant panel with the bar mounted;

In the drawings the same reference has been allocated to the same elements or to similar elements.

Figure 1:
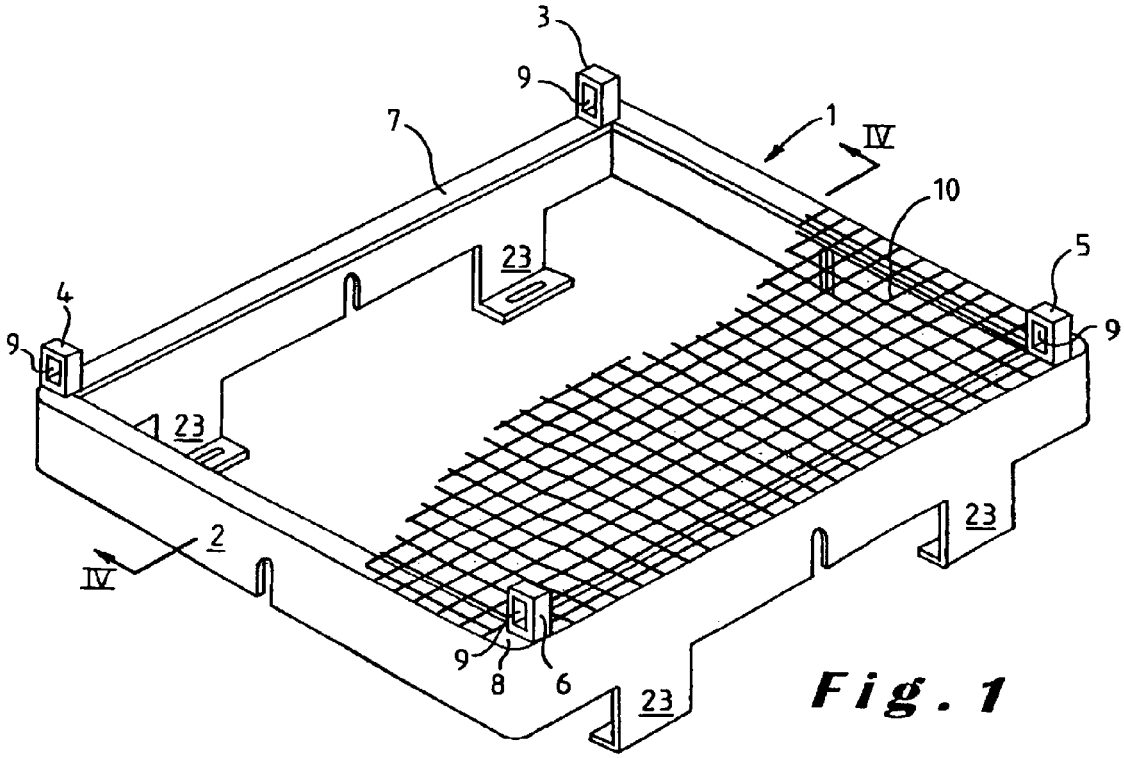
Figure 6:
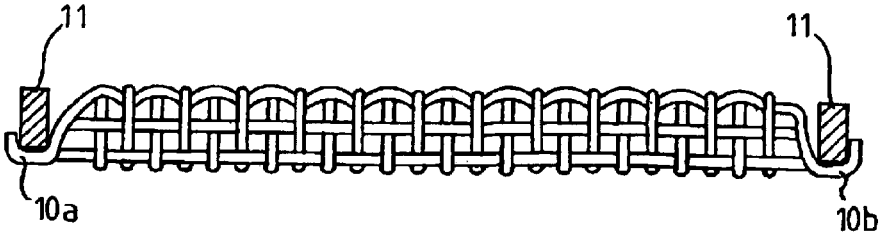
FIG. 6 illustrates a section along the line VI–VI' (FIG. 1)

The radiant panel 1 according to the invention illustrated in FIG. 1 comprises a frame 2 which surrounds a grille 10. This grille serves as a protective element for a combustion support (not included in the drawings) which is held by lugs 23. The grille also serves to increase the radiation from the radiant panel. Preferably, as illustrated in FIG. 6, the grille comprises longitudinal edges 10*a* and 10*b* in the form of a ledge and which serve to receive bars 11, as will be described in more detail below. This shape of the grille edges keeps the grille colder at this point and thus prevents expansions from dislodging the grille.

Figure 8:
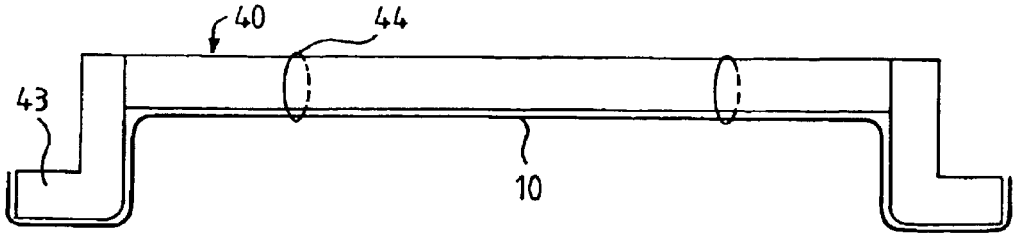
FIGS. 8 and 9 illustrate another embodiment of the grille.
Figure 9:
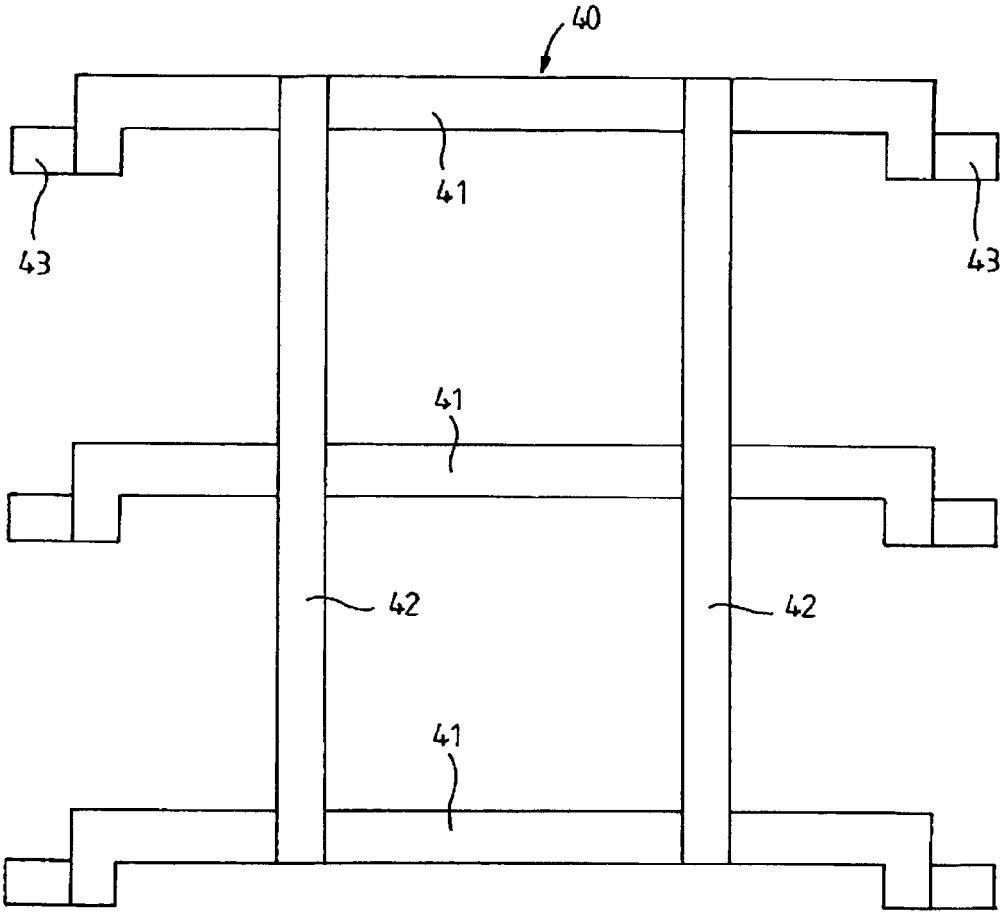

FIGS. 8 and 9 illustrate another embodiment of the grille 10 and of the means with which the grille and the frame 2 are connected together. The grille is fixed to a framework 40 formed by small transverse 41 and longitudinal 42 bars. The framework is also provided with feet 43 arranged so as to bear on the frame. Despite the fact that FIG. 9 illustrates a set of small transverse and longitudinal bars, it is also possible to form the framework using solely small transverse bars or solely small longitudinal bars. The grille itself is then either suspended from the framework or placed on the framework and fixed by means of brackets 44 or other fixing means. When the grille is suspended from the framework, as illustrated in FIG. 8, it also extends below the feet 43.

The embodiment illustrated in FIGS. 8 and 9 makes it possible to use different materials for the grille and framework. Thus the grille will be manufactured from aluminum or an alloy based on aluminum. The framework for its part will be manufactured from a nickel-chromium alloy or from cast iron. The use of aluminum or an alloy based on aluminum is because this material resists corrosion better than nickel-chromium. However, as aluminum resists creep less well, the framework makes it possible to support the grille when it creeps due to the high temperature.

Each longitudinal edge 7, 8 of the frame 2 comprises a pair of projections 3 and 4 and respectively 5 and 6. According to another embodiment of a radiant panel according to the invention, only one pair of projections on one and the same longitudinal edge could suffice, the grille then being held by other means on the other longitudinal edge. The projections are perfectly placed on the corners of the frame in order thus to give maximum length to the bars and provide optimum support for the grille. Naturally the projections can also be placed at points on the longitudinal edge other than those formed by the corners. However, it is necessary for the first (3 or respectively 5) and the second (4 or respectively 6) projection in one and the same pair (3, 4 or respectively 5, 6) of projections to be disposed at a distance from each other. Thus, for an edge having a length of 187 mm, the distance between two projections must be at least 90 mm.

Each projection 3, 4, 5 and 6 is provided with an orifice 9, which is preferably rectangular in shape. These orifices serve for the passage of movable bars 11 illustrated in FIGS. 2 and 3. Each movable bar, when the grille and bar are mounted on the frame, passes through one of the pairs of projections as illustrated in FIGS. 4 and 5. When the bars 11 are engaged in the orifices in the projections which have been allocated to them, they serve to hold the grille 10 in place by pressing it against the frame 2. When the grille has edges in the form of a ledge (see FIG. 6), the bars come to be housed in these ledges, thus holding the grille firmly in place.

Each bar 11 comprises a first 13 and second 17 end situated opposite each other. The first end 13 preferably comprises a rounded shape, which firstly substantially reduces the probability of the operator injuring himself thereon when he handles the bar and secondly facilitates the pivoting of the bar in the orifice, as will be described below.

Figure 4A:
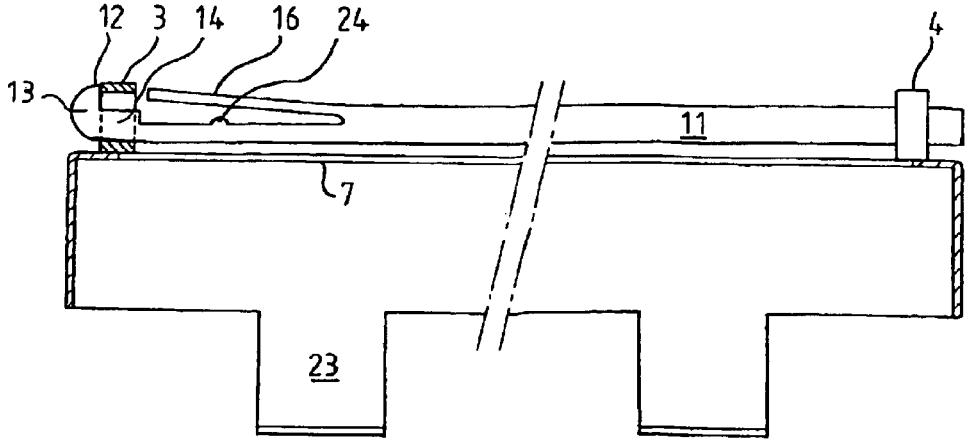
Figure 4B:
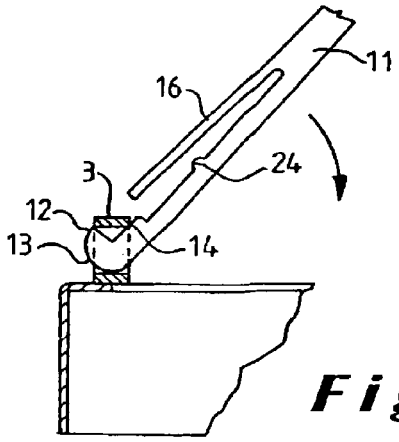
Figure 5:
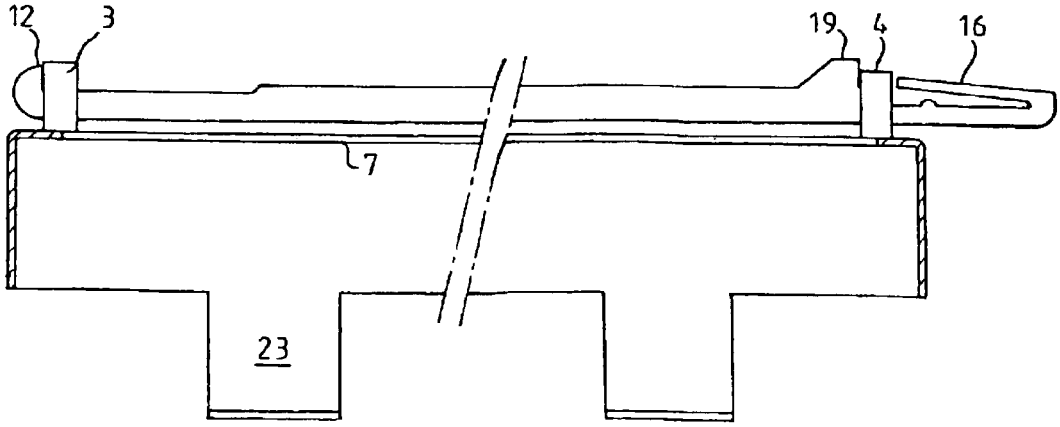

The first end 13 of the bar also comprises a first tooth 12 sized so as to be able to pass through the orifice 9 whilst making the bar 11 pivot as illustrated in FIG. 4*b*. Thus, for a height of the orifice 9 of 5 mm, the first tooth has a height of 5.5 to 6 mm. This prevents the bar not only from being inserted horizontally in the orifice 9 but also emerging from the orifice when the bar is situated in the horizontal position of fixing the grille.

The bar also comprises a flexible blade 16 arranged so as to limit the movement of the bar 11 when it is in a position of fixing the grille.

Figure 2:
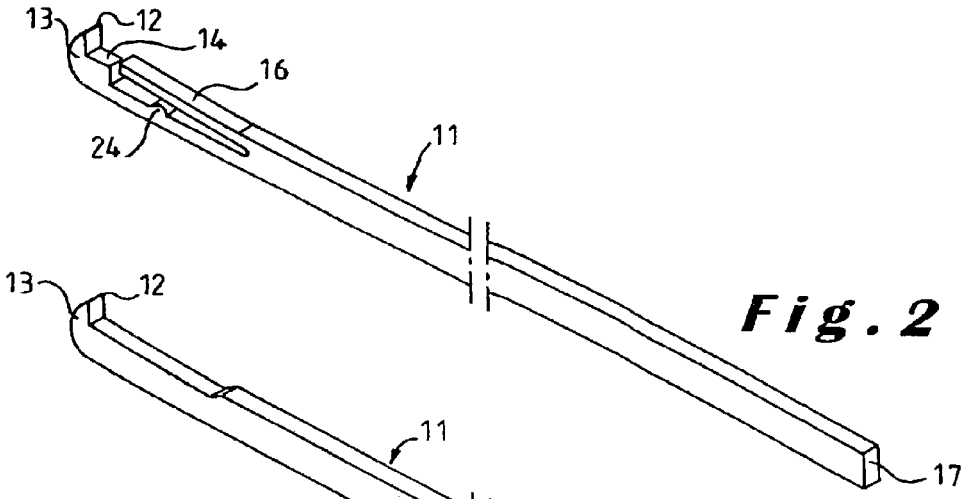
Figure 3:
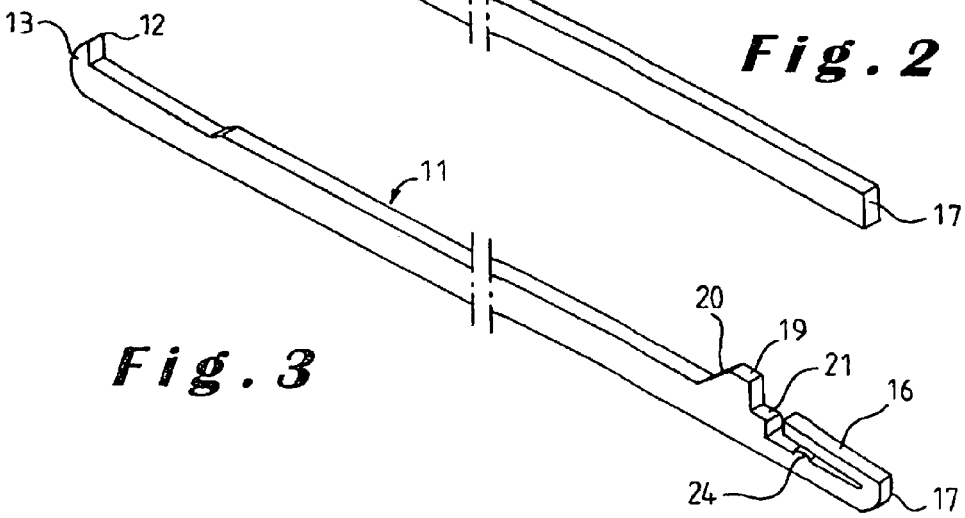

In the example embodiments illustrated in FIGS. 2 and 3, the flexible blade is obtained by cutting from the very mass of the bar, thus creating a longitudinal slot over a small distance in the bar. In the first embodiment, illustrated in FIG. 2, the flexible blade is situated at the first end 13 of the bar, whilst in the second embodiment illustrated in FIG. 3 the flexible blade is situated at the second end 17 of the bar. The flexible blade has for example a thickness of 1 to 2 mm and extends over a length of 10 to 25 mm.

In the embodiment of the bar illustrated in FIG. 2, the bar also comprises a second tooth 14 juxtaposed with the first tooth 12. The second tooth has a height appreciably less than that of the first, for example 5 mm. The second tooth is sized so as to be situated in the orifice when the bar is in its fixing position. Thus, as illustrated in FIG. 4*a,* the presence of this second tooth in the orifice limits a vertical movement of the bar in this orifice. The second tooth has for example a length of 5 mm, corresponding to that of the projection.

A ridge 24 is situated under the flexible blade 16 in order to limit the downward movement of the tip of the blade, preventing excessively great downward flexion which would enable the blade to pass through the orifice when the bar is in the fixing position.

In the second example embodiment set out in FIG. 3, the bar comprises a third tooth 19 having an inclined flank 20. The third tooth is placed at a distance from the flexible blade 16 so that the flexible blade and the third tooth extend on each side of the second projection when the bar is in its fixing position. The third tooth has for example a height of 10 mm. The third tooth is juxtaposed with a fourth tooth 21 which is sized so as to be situated, just like the second tooth 14, in the orifice when the bar is in its fixing position.

Figure 10:
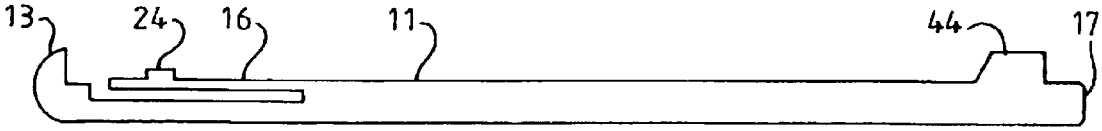
FIG. 10 illustrates another embodiment of the bar.

The embodiment of the bar 11 illustrated in FIG. 10 is distinguished by the presence of the stop 24 on the flexible blade 16 rather than below it. This prevents the bar from passing across the projection when it is fitted. The bar illustrated in FIG. 10 also comprises an appendage 44 which extends vertically with respect to the base of the bar and which is situated close to the second end 17. This appendage facilitates handling of the bar. This is because, since there is more material present by virtue of the appendage, a better grip is provided.

To engage the bar according to FIG. 2 in the orifices in the projections, the first end 13 is introduced, for example in the projection 3, by inclining the bar at an angle of approximately 20° to 30° and making it pivot towards the edge of the frame 2 as illustrated in FIG. 4*b*. When the first tooth has passed the orifice, the pivoting causes the first tooth to come to be placed against the projection. The bar is then slid horizontally through the orifice by pressing on the flexible blade so that the tip of the flexible blade can enter the orifice. The bar is slid through this orifice over a sufficient distance to allow the engagement of the second end of the bar in the orifice in the projection 4. The bar is then withdrawn so that the second end can enter the orifice in the second projection. The withdrawal of the bar is stopped by the first tooth, which abuts against the first projection. When the bar is in place in the projections, the second tooth 14 is situated in the opening and the first tooth 12 and the flexible blade are situated on each side of the first projection, thus fixing the bar in the orifices and the grille against the frame.

In the second embodiment of the bar illustrated in FIGS. 3 and 5, the first tooth is engaged in the same way as that described previously. As the flexible blade is situated at the second end of the bar it is engaged in the second projection, after the first tooth has passed through the first projection by causing it to pass completely through the orifice in the second projection. Thus the third tooth 19 and the flexible blade 16 will be situated on each side of the second projection.

Figure 7:
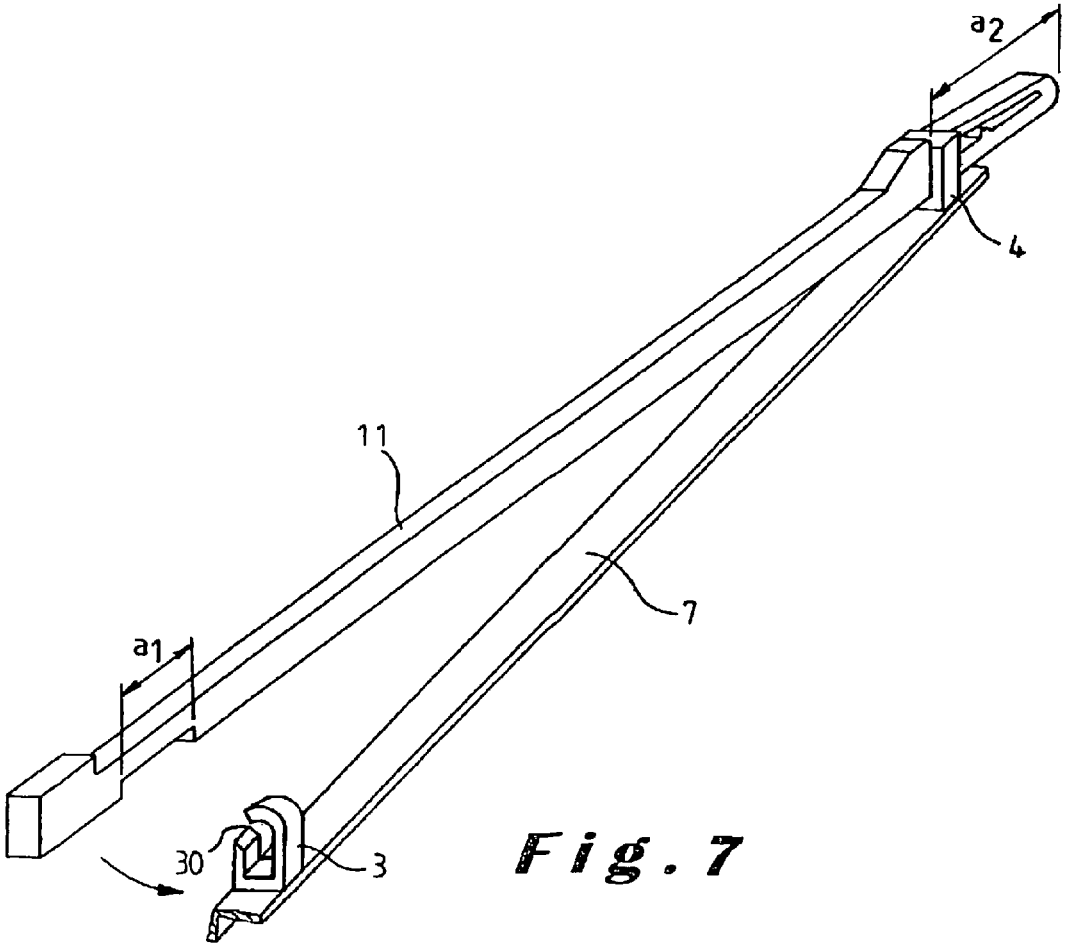
FIG. 7 illustrates another embodiment of a radiant panel.

According to the embodiment illustrated in FIG. 7, the second projections of each pair each have a cutout 30 extending over a peripheral part of this second projection and giving access to the orifice. The cutout in each projection is disposed so as to be oriented towards the internal periphery of the radiant panel, which makes it possible to hold the grille better when it is fitted. The cutout is preferably aslant, thus making it possible to follow the inclination of the grille. In this embodiment it is important for the parts d1 and d2 of the bars to have substantially equal lengths so as to enable them to be inserted in the projections.

Thus, when the second end of the bar is engaged in the orifice in the second projection, the flexible blade folds slightly, whilst it passes into the orifice. Once it has passed beyond this orifice, the flexible blade resumes its initial shape, so that the free end of the blade comes to abut against the second projection, when it is attempted to make the bar return backwards. When the engagement of the bar in the orifices is continued, the first tooth comes to be placed against the first projection so as to prevent the bar from passing through the orifice in the first projection.

Thus, according to FIG. 7, when the second end is engaged in the orifice in the second projection, the operator can make the bar pivot in a plane essentially parallel to the plane of the frame 1 and place the bar facing the cutout. The transverse section of the bar at the height of the projection is arranged so as to be able to pass into the cutout and thus gain access to the orifice.

The cutout can be on the rising peripheral edges of the projection or extend from the top of the projection as far as the orifice in this second projection. Once the ends of the bar are engaged in their respective projections, the bar serves to press the grille on the frame.

According to one alternative, the bar may be resilient, and in this way the pivoting of the second end would take place by flexion of the bar with respect to the first end, engaged in the first projection. Once the hollow is placed facing the projection, the bar returning to its original shape could itself be engaged in the orifice in the first projection via the cutout.

What is claimed is:

1. A radiant panel provided with a frame on which at least one pair of projections, each comprising a first and second projection, are disposed, the first and second projections being in each case disposed at a distance from each other on a longitudinal edge of the frame, each projection being provided with an orifice, said radiant panel also comprising, per pair of projections, a movable bar having a first and second end situated opposite to each other, said bar being arranged so that each of the ends can be engaged in one of the respective orifices, said bar serving to press a grille against the frame, the first end of the bar comprising a first tooth sized so as to be able to pass through said orifice whilst making the bar pivot and abut against the projection when the bar passes through the orifice, the bar also comprising a flexible blade arranged so as to limit the movement of the bar when, in the grille fixing position, it passes through the orifices in the pair of projections to which it has been allocated.

2. A radiant panel as claimed in claim 1, wherein a second tooth juxtaposes the first tooth, said second tooth being sized so as to be situated in the orifice when the bar is in said fixing position.

3. A radiant panel as claimed in one of claim 1 or 2, wherein said first end has a rounded shape.

4. A radiant panel as claimed in one of claim 1 or 2, wherein the first tooth and the flexible blade are applied to one and the same end of the bar and extend on each side of the orifice when the bar is in said fixing position.

5. A radiant panel as claimed in claim 1, wherein the flexible blade is situated at the second end of the bar.

6. A radiant panel as claimed in claim 5, wherein the bar comprises a third tooth placed at a distance from the flexible blade and situated so that the flexible blade and the third tooth extend on each side of the second projection when the bar is in said fixing position.

7. A radiant panel as claimed in claim 5, wherein a second tooth juxtaposes the first tooth, said second tooth being sized so as to be situated in the orifice when the bar is in said fixing position, and wherein the bar comprises a third tooth placed at a distance from the flexible blade and situated so that the flexible blade and the third tooth extend on each side of the second projection when the bar is in said fixing position.

8. A radiant panel as claimed in claim 6 or 7, wherein a fourth tooth juxtaposes the third tooth, said fourth tooth being sized so as to be situated in the orifice when the bar is in said fixing position.

9. A radiant panel as claimed in claim 1, wherein the bar comprises a stop situated either under the flexible blade or on the flexible blade.

10. A radiant panel as claimed in claim 1, wherein the grille comprises a longitudinal edge having the form of a ledge and arranged so as to house the bar therein.

11. A radiant panel as claimed in claim 1, wherein the grille is fixed to a framework, which is placed on the frame.

12. A radiant panel as claimed in claim 1, wherein the grille comprises a longitudinal edge having the form of a ledge and arranged so as to house the bar therein, said grille being fixed to a framework, which is placed on the frame.

13. A radiant panel as claimed in claim 11 or 12, wherein the said framework is fabricated either from nickel-chromium alloy or from cast iron, said grille being fabricated either from aluminum or from an alloy based on aluminum.

* * * * *